US005893007A

United States Patent [19]

Lim

[11] Patent Number: 5,893,007

[45] Date of Patent: Apr. 6, 1999

[54] COMBINATION DEVELOPMENT UNIT AND TONER LEVEL DETECTION SERVICE

[75] Inventor: Young-Taek Lim, Seongnam, Rep. of Korea

[73] Assignee: SamSung Electronics Co., Ltd., Suwon, Rep. of Korea

[21] Appl. No.: 984,072

[22] Filed: Dec. 3, 1997

[30] Foreign Application Priority Data

Dec. 24, 1996 [KR] Rep. of Korea ..... 1996-71715

[51] Int. Cl.[6] ..... G03G 15/00; G03G 15/08

[52] U.S. Cl. ..... 399/13; 399/27

[58] Field of Search ..... 399/13, 25, 27, 399/30, 35

[56] References Cited

U.S. PATENT DOCUMENTS 4,739,365 4/1988 Hino .
4,951,091 8/1990 Nawata .
5,095,331 3/1992 Takano .
5,428,427 6/1995 Lee ..... 399/30
5,436,704 7/1995 Moon .
5,784,665 7/1998 Bae ..... 399/13

FOREIGN PATENT DOCUMENTS 5-297718 11/1993 Japan .

*Primary Examiner*—Joan Pendegrass
*Attorney, Agent, or Firm*—Robert E. Bushnell, Esq.

[57] ABSTRACT

A combination developer unit and toner level detection device increases the efficiency of manufacturing an electrophotographic apparatus and correspondingly lowers the cost of production. This device employs a spring biased actuator in combination with a magnet and optical sensors to provide the functions of two detection devices in a single detection device.

23 Claims, 7 Drawing Sheets

COMBINATION DEVELOPMENT UNIT AND TONER LEVEL DETECTION SERVICE

CLAIM OF PRIORITY

This application makes reference to, incorporates the same herein, and claims all rights accruing thereto under 35 U.S.C. §119 through my patent application entitled *Device for Detecting a Toner Cartridge Mounted in an Electrophotographic Apparatus and the Toner Contained Therein* earlier filed in the Korean Industrial Property Office on the 24th day of Dec. 1996 and there duly assigned Ser. No. 1996/71775.

BACKGROUND OF THE INVENTION

1. Field of the Invention

The present invention concerns a device for an electrophotographic apparatus and, more specifically, a device for detecting the presence of a developing unit and the toner level contained in the developing unit.

2. Background Art

Monitoring the presence of a developing unit and the level of toner of the cartridge is crucial for the proper operation of an electrophotographic apparatus during the printing process. An electrophotographic apparatus can be either one of a laser printer, an electronic copier, a facsimile machine, or any versatile office machine. The general operation of an electrophotographic apparatus starts with paper being loaded as from a supply tray and then transported through to a high pressure transfer unit. The high pressure transfer unit places the toner image onto the sheet of paper. Subsequently, the paper is transported to a fixing device that fixes the toner image onto the paper using both heat and pressure rollers.

To prepare the toner image for the high pressure transfer unit, it is necessary to attach toner particles to the latent electrostatic image on the photoconductive drum. The toner particles are applied by a the developing unit, thereby transforming the latent electrostatic image into a latent toner image. Thus, the level of toner in the developing unit is critical to the proper operation of the electrophotographic apparatus. This importance has lead to many developments in toner detection methods. By way of example, U.S. Pat. No. 5,436,704 to Moon entitled *Device for Sensing the Amount of Residual Toner of Developing Apparatus*, mentions using a reed switch in combination with an magnet bearing actuator to determine the amount of toner remaining in a developing unit, and U.S. Pat. No. 5,428,427 to Lee entitled *Device for Detecting Toner Used in an Electrophotography Machine*, shows a device employing a magnet to determine whether fresh toner needs to be supplied to the developing unit. Some other patents representative of the art are: U.S. Pat. No. 5,095,331 to Takano entitled *Image Forming Apparatus Having Toner-Empty Detecting and Indicating Mechanism*; U.S. Pat. No. 4,951,091 to Nawata entitled *Image Forming Apparatus Having Toner Quantity Detection Means*; and U.S. Pat. No. 4,739,365 to Hino entitled *Developing Unit for an Electro-Photographic Apparatus.*

I have observed that the electrophotographic apparatuses in the art require an additional detector to determine the presence of a developing unit as well the level of toner in the developing unit. The use of two detectors increases the complexity of assembly and correspondingly increases the cost of the electrophotographic apparatus. I expect that a device that both determines whether a developing unit is present in an electrophotographic apparatus and whether the toner needs to be replaced will increase the efficiency of manufacture of electrophotographic apparatus and lower the cost of production.

SUMMARY OF THE INVENTION

Accordingly, it is an object of the present invention to provide an improved electrophotographic apparatus.

It is another object to provide a device that detects the level of toner in a developing unit or toner cartridge.

It is still another object to provide a device that detects the presence of a developing unit or toner cartridge in an electrophotographic apparatus.

It is yet another object to provide a detection device that lowers the cost of assembling an electrophotographic apparatus.

It is still yet another object to provide a detection device that lowers the cost of production of an electrophotographic apparatus.

To achieve these and other objects, a device for detecting a toner cartridge may be mounted in an electrophotographic apparatus beneath the development unit or toner cartridge. The device may be constructed using a housing having a box-like shape. The housing has a centrally elongated cavity with one of a pair of opposing grooves in each side at the end of the cavity. A spring biased actuator is supported in the center of the housing with an end protruding through each groove. In each of the two walls parallel to the actuator's plane of rotation is one of a pair of opposing slots. The actuator is supported in the elongated cavity and a cover is placed over the actuator. The cover has three apertures located over both slots and the axis of rotation of the actuator. A support plate having three legs is then attached to the housing by sliding the legs though the apertures in the cover. Positioned near the housing is an optical sensor that one end of the actuator blocks when rotated downwards. The other end of the actuator contains a magnet that is attracted to the toner in the developing unit.

When a developing unit is placed on the in the electrophotographic apparatus it depresses the support plate. This lowers the actuator to a height slightly above the optical sensors. The toner in the development unit attracts the magnet on one end of the actuator and causes the other end to rotate downwards and interrupt the optical sensor. As the level of toner approaches exhaustion the actuator begins to waver and the optical sensor is able to produce a voltage between 2 V and 5 V. This indicates that the toner in the developing unit is low. When the toner is exhausted the optical sensor generates its full voltage signaling an out of toner condition. When a developing unit or toner cartridge is not placed inside the electrophotographic apparatus the actuator remains horizontally above the optical sensor. As such, the optical sensor generates its full voltage value. Thus, the device can detect both when a developing unit is not present and when the toner level is low or exhausted.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the or similar components, wherein.

DETAILED DESCRIPTION OF THE PREFERRED EMBODIMENT

Figure 1:
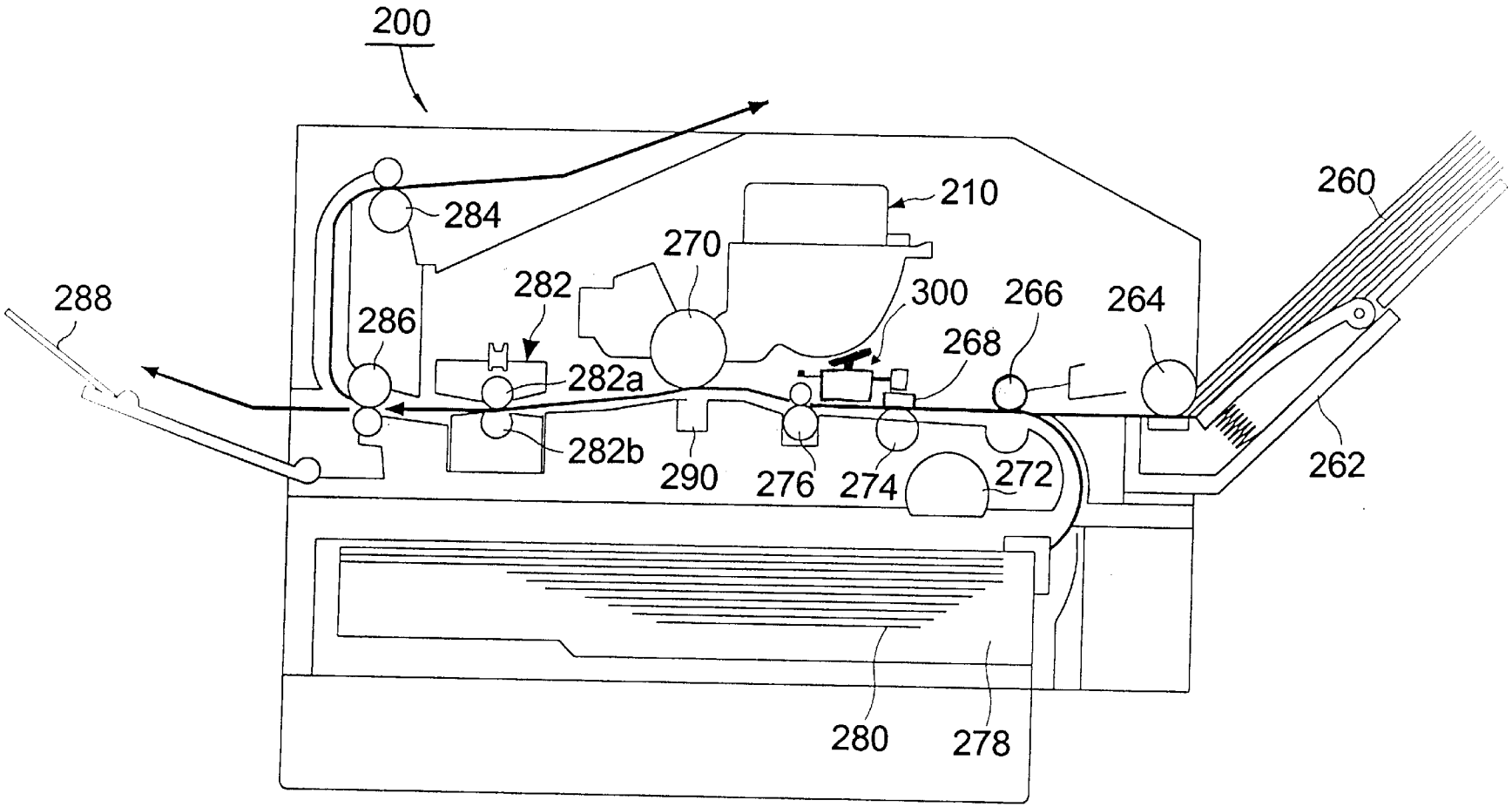
FIG. 1 is a view of an electrophotographic apparatus that utilizes a detection device constructed according to the principles of the present invention.

Turning now to the drawings, FIG. 1 illustrates the operation of a typical versatile office machine 200. Sheet of paper 260 is loaded from document tray 262 and transported to contact image sensor (CIS) 268, by automatic document supplying roller 264. The CIS scans the document. Then, CIS 268 generates a light beam to scan sheet of paper 260. The light beam passes through the document and is reflected by white roll 274. The reflected light beam is detected by an optical sensor that produces corresponding image data. Subsequently, paper 260 passes by photoconductive drum 270 and is then fixed by a fixing unit. Then pickup roll 286 and discharging roll 284 eject the document.

During the beginning of the printing operation the surface of photoconductive drum 270 is uniformly charged by a charging unit provided in versatile office machine 200. Then, the surface of photoconductive drum 270 is exposed to a light beam produced by an exposing unit, thus forming an electrostatic latent image. The electrostatic image is then transformed to a latent toner image by fine toner particles that are attached by developing unit 210. Detecting device 300 determines if developing unit 210 is mounted in versatile office machine 200 and whether it has toner inside of it. The toner image formed on photoconductive drum 270 is transferred to the paper by high pressure transfer unit 290. The toner image is fixed on paper 260 by the fixing unit's heating roll 282*a* and pressure roll 282*b*. Then, sheet 260 is discharged by discharging roll 284 and ejected from the electrophotographic machine.

Figure 2:
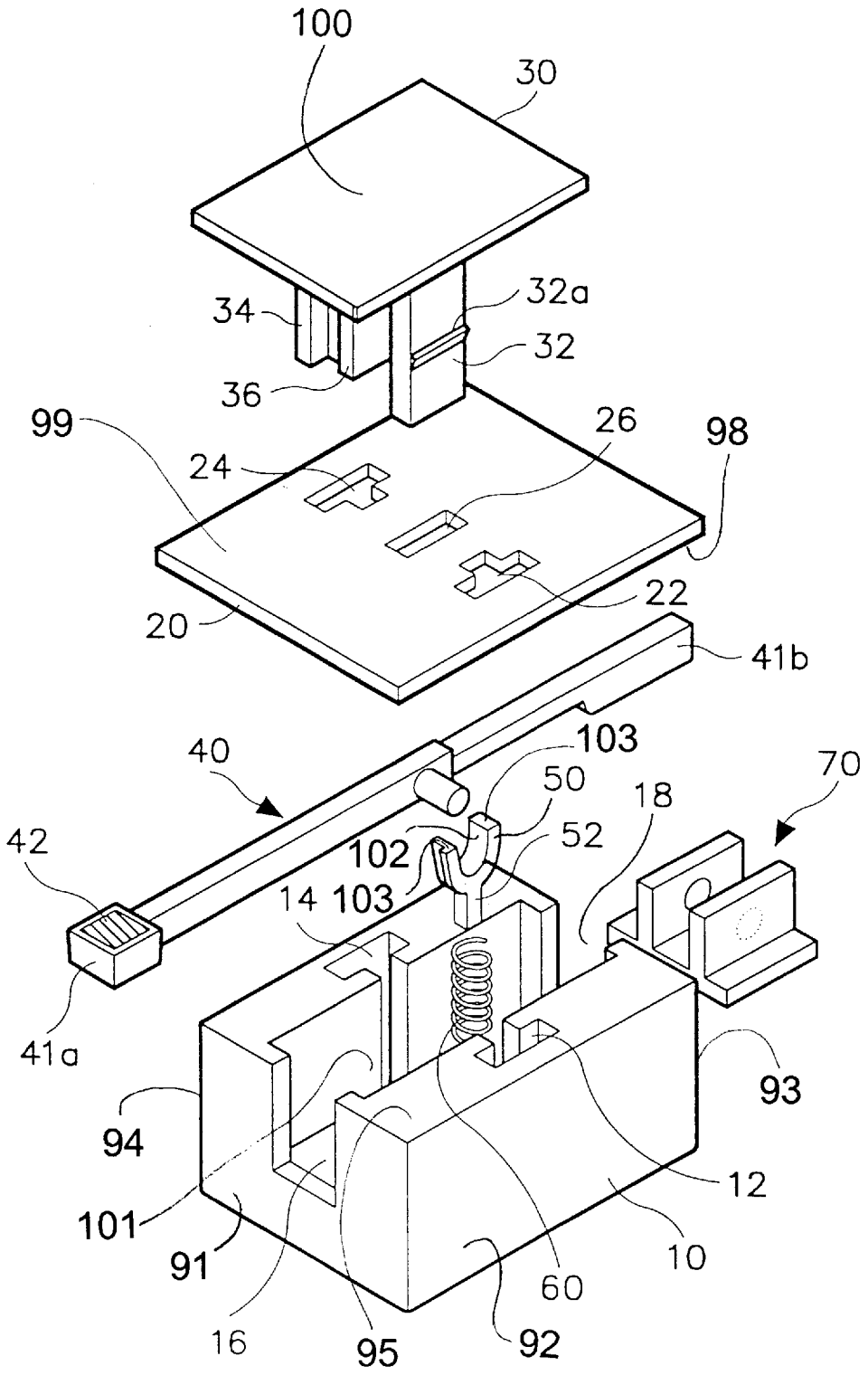
FIG. 2 is a perspective view of the detection device as constructed according to the principles of the present invention.

As shown in FIG. 2, the combination development unit and toner level detection device may be constructed using a housing having a box-like shape. Housing 10 has a centrally elongated cavity with one of opposing grooves 16 and 18 in sides 91 and 93 at each end of cavity 101. Spring biased actuator 40 is supported the interaction of shaft 44 and surface 102 of bushing 50 in the center of housing 10 with an end protruding through each groove. Actuator end 41*a* protrudes through groove 16 and contains magnet 42. Actuator end 41*b* protrudes through groove 18. Bushing 50 is supported by member 52 that is attached to biasing spring 60. Biasing spring 60 is attached on the opposite end to protruding member 11. Walls 92 and 94 are parallel to the actuator's plane of rotation and each contain one of opposing slots 12 and 14. Actuator 40 is contained within elongated cavity 101 and cover 20 is placed over the actuator. Surface 98 of the cover comes into contact with surface 95 of the housing when the cover is attached. Cover 20 has three apertures 22, 24, and 26 located over both slots 12 and 14 and over bushing 50 located at the axis of rotation of the actuator. Support plate 30 has three legs 32, 34, and 36 that are inserted through cover 20 and into slots 14 and 12 and onto surface 103 of bushing 50. Legs 32 and 34 insert through apertures 22 and 24 and slidably engage slots 12 and 14, respectively. Legs 32 and 34 have abutting ridges 32*a* that prevent the legs from penetrating too far into the housing. Positioned near the housing is optical sensor 70 that is interrupted by actuator end 41*b* when a developing unit or toner cartridge that is not low on toner is placed on surface 100 of supporting plate 30.

Figure 3:
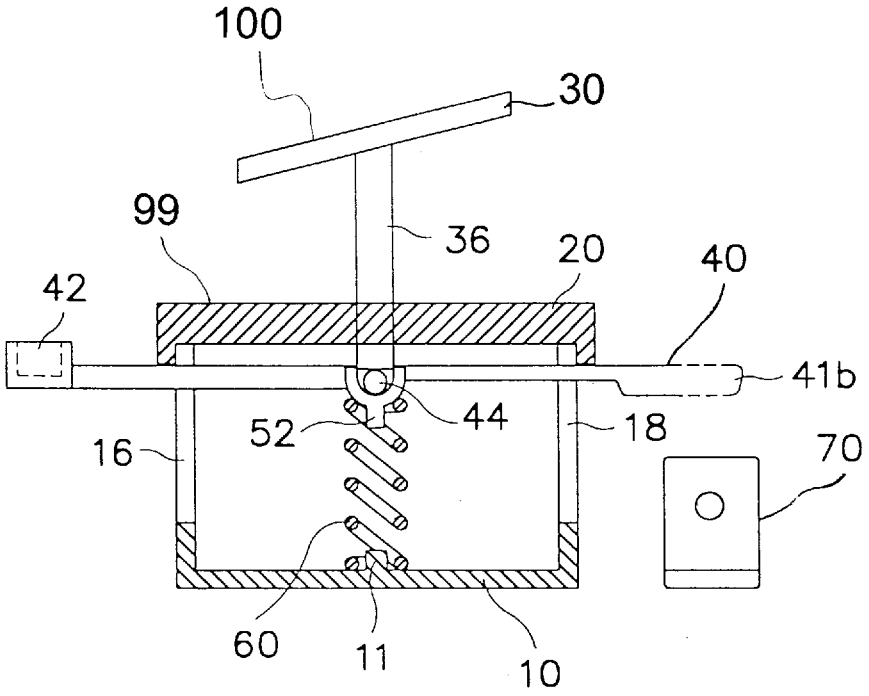
FIG. 3 is cross sectional view of the device of FIG. 2 showing the position of the actuator when there is no developing unit inside the electrophotographic apparatus.

When the toner cartridge is not mounted on the toner cartridge support plate, as shown in FIG. 3, the actuator bar 40 is held horizontally above the optical sensor. The vertical force is exerted by spring 60 onto bushing 50 and thus onto actuator 40. The horizontal alignment of actuator 40 is due to a lack any charged toner to attract the magnet and thus rotate the actuator. Hence, the other actuator end 41*b* does not interrupt the transmission of light by optical sensor 70. As an example, this orientation of the detection device could correspond to a constant 0 V signal being produced by the detection device.

Figure 4:
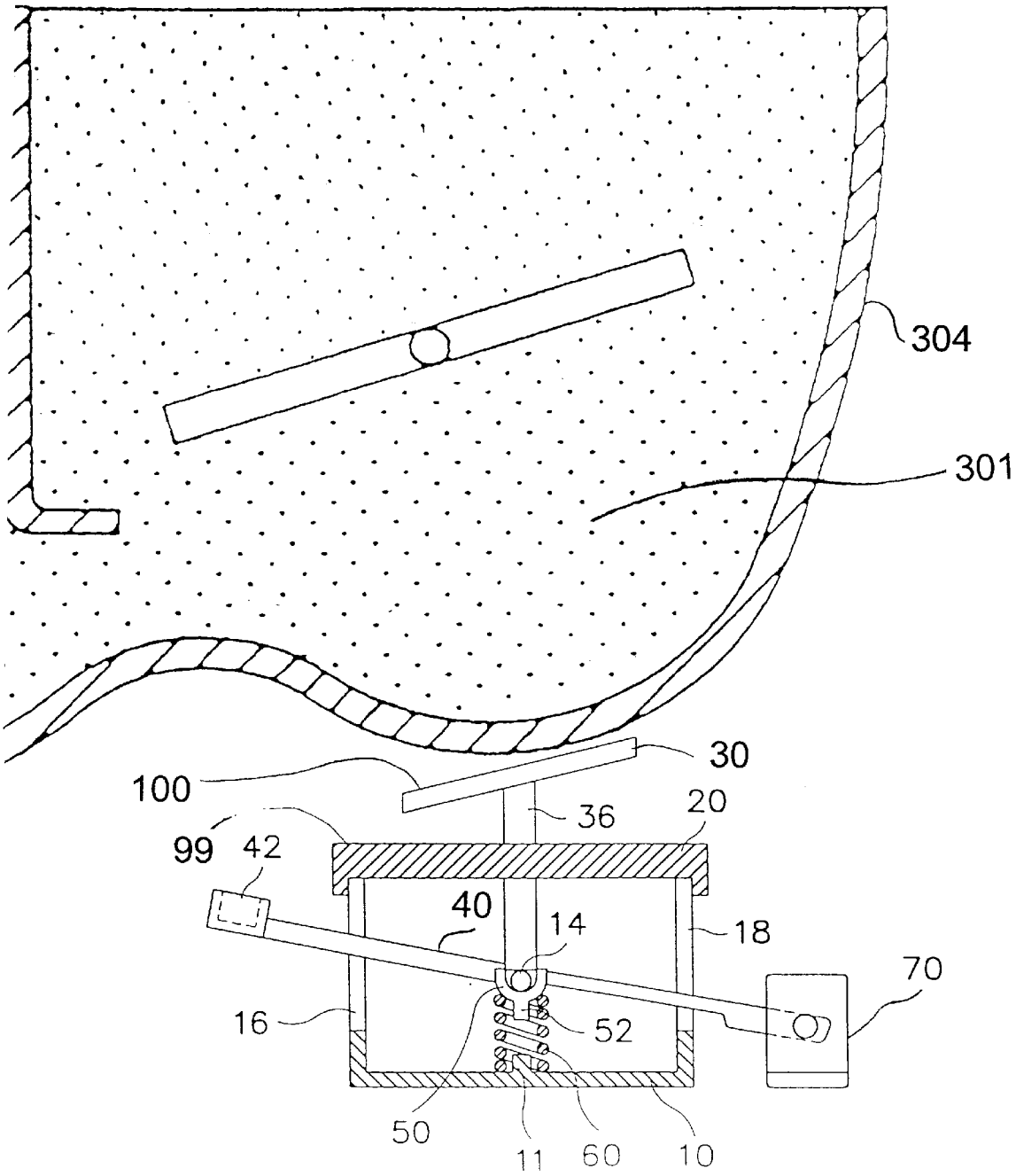
FIG. 4 is a cross-sectional view of the device of FIG. 2 showing the position of the actuator when a developing unit with a full supply of toner is mounted on the supporting plate of the combination developing unit and toner level detector.

When a developing unit is mounted on support plate 30, actuator 40 is pushed toward the base of the housing. Thus, spring 60 is compressed by the force generated by the weight of the developing unit, as shown by FIG. 4. As the developing unit is placed on supporting plate 30, legs 32 and 34 are inserted through apertures 22 and 24 and inserted into slots 12 and 14. At the same time central leg 36 pushes surface 103 of bushing 50 toward the base of housing 10. Then, actuator 41*a* is moved toward the developer unit by the force between magnet 42 and the magnetic field created by charged toner 301 in developing unit 304. This causes actuator end 41*b* to rotate and interrupt the signal of the optical sensor by interposing actuator end 41*b* between the light emitter and the light receptor. As an example, this orientation of the detection device could correspond to a voltage of 5 V being produced by the detection device.

Figure 5:
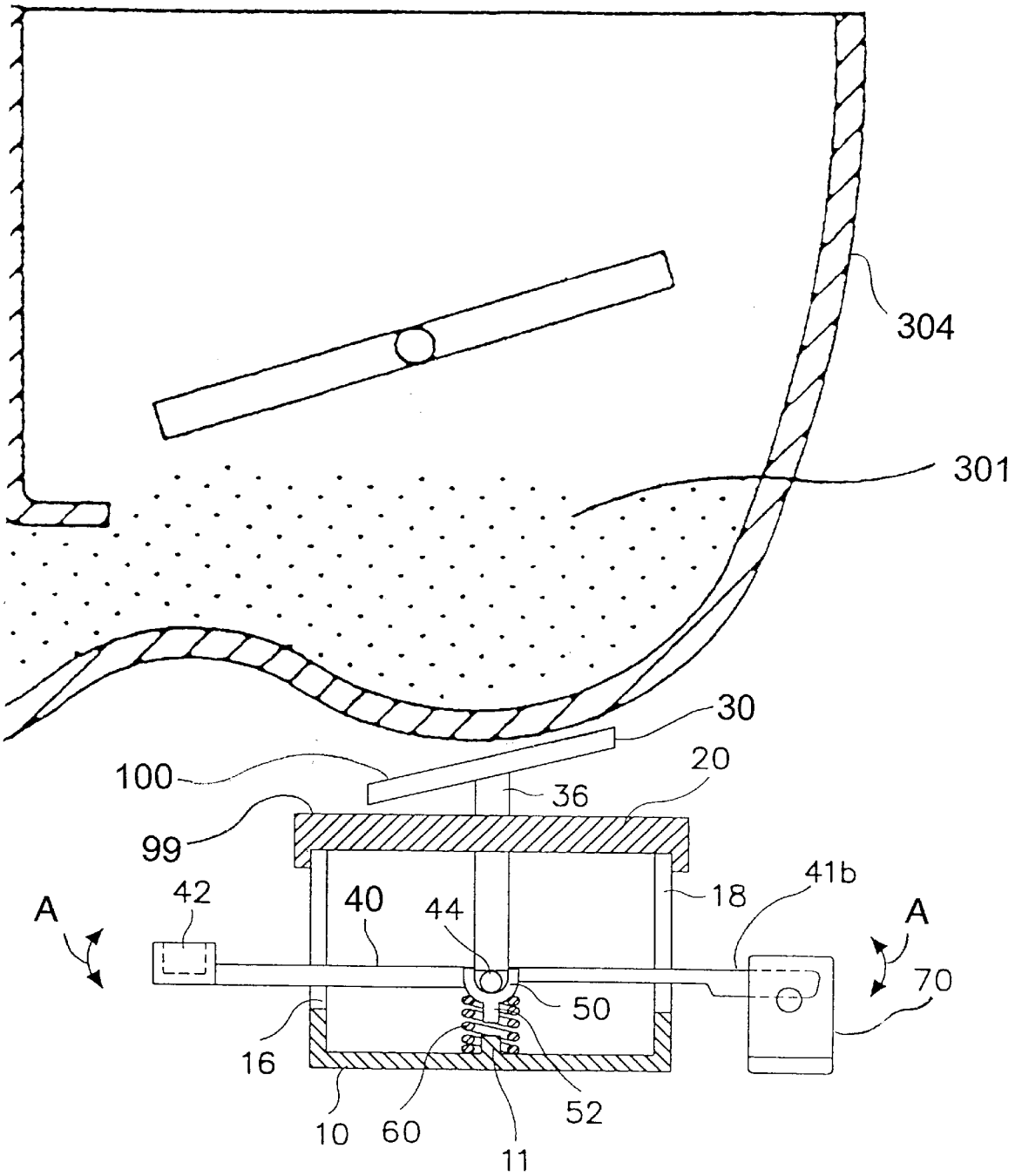
FIG. 5 is a cross-sectional view of the device of FIG. 2 showing the position of the actuator when a developing unit that is low on toner is mounted on the support plate of a combination developing unit and toner level detector.

As toner 301 in the developing unit is depleted the intensity of the magnetic field caused by the charged toner is reduced. This reduces the attractive force between toner 301 and magnet 42 and causes actuator end 41*a* to rotate. This gradually increases the distance between the bottom of the toner cartridge and actuator end 41*a*, as shown in FIG. 5. Actuator end 41*a* fluctuates slightly, as shown by the arrows denoted 'A', until the attractive force between the toner and the magnet is overcome by the force of gravity.

During this period of slight fluctuations, optical sensor 70 could generate between 2 V through 5 V depending on whether actuator end 41*b* fully or partially obstructs the light signal path of the optical sensor. By monitoring the frequency of voltage fluctuations a user may determine when a developing unit or a toner cartridge should be replenished with fresh toner or simply replaced. When a developing unit is removed from the support plate, actuator 40 is pushed upward by spring 60. This causes actuator end 41*b* to be raised above optical sensor 70. As an example, this orientation of the detection device could correspond to a voltage of 5 V being produced by the detection device.

Figure 6:
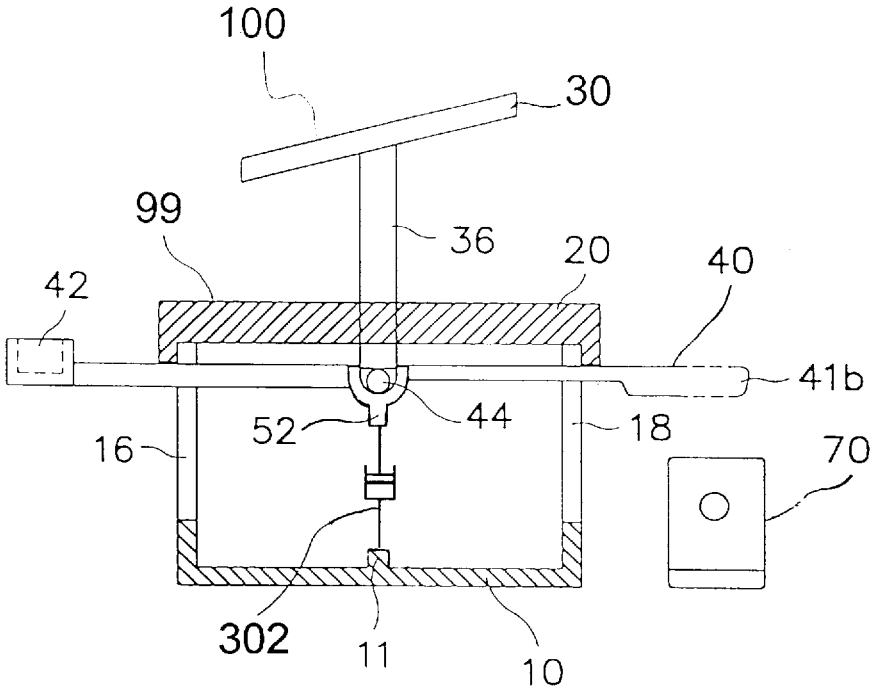
FIG. 6 is a cross sectional view of the device of FIG. 2 showing a hydraulic shock absorber substituted for the spring.

FIG. 6 shows hydraulic shock absorber 302 used instead of spring 60. The use of hydraulics instead of springs allows for a smoother movement of the actuator towards the base of housing 10.

Figure 7:
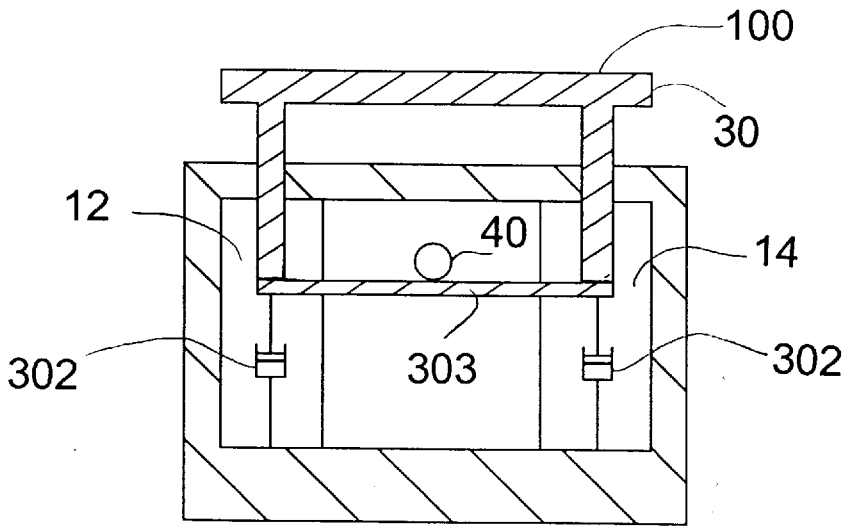
FIG. 7 is a cross-sectional view of a combination developing unit and toner level detector viewed along the length of the actuator constructed as a second embodiment according to the principles of the present invention.
Figure 8:
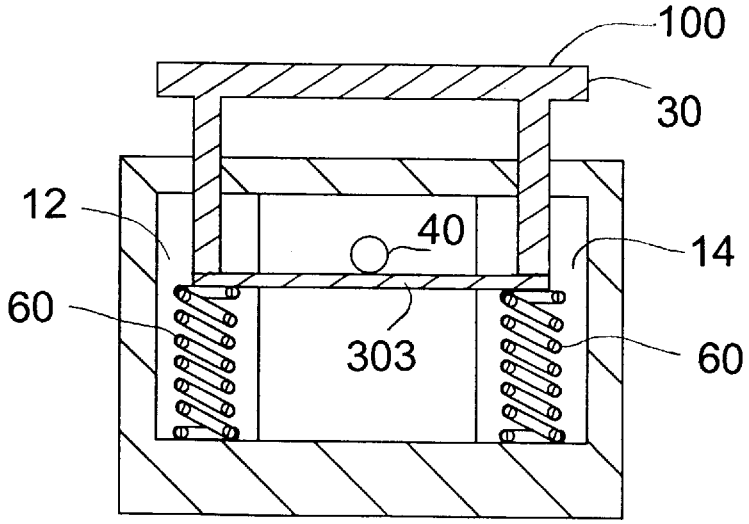
FIG. 8 is a cross sectional view of a the device of FIG. 7 with springs substituted for the shock absorbers.

A second embodiment of a combination developing unit and toner level detector is shown in FIGS. 7 and 8. FIG. 7 shows hydraulic damping devices contained inside opposing slots 12 and 14 in the side walls of the detection device. The damping devices are attached at one end to rod 303 that rotably supports actuator 40. The cover has two perforations positioned over the slots allowing the two legs of the supporting plate to contact the upper surface of rod 303. This embodiment has the advantage of only requiring two perforations in the cover and more carefully maintaining precise vertical movement of the actuator. The rod actually extends through the slits adjoining the rods, as shown in FIG. 2. FIG. 8 shows the second embodiment using springs 60 instead of hydraulic damping devices 302.

The above combined developing unit and toner level detection device increases the efficiency of manufacturing of an electrophotographic apparatus and the cost of production of an electrophotographic apparatus is correspondingly reduced. Although this preferred embodiment of the present invention has been disclosed for illustrative purposes, those skilled in the art will appreciate that various modifications, additions and substitutions are possible, without departing from the scope and spirit of the invention as disclosed in the accompanying claims. It is also possible that other benefits or uses of the currently disclosed invention will become apparent over time.

What is claimed is:

1. A device for combination developing unit and toner level detecting, comprising:

a housing having a base, and a cavity in a surface opposite said base, said cavity centrally located in said housing, said cavity forming two end walls and two side walls, said end walls having a pair of opposing grooves perpendicular to the plane of said base;

an actuator pivotally supported by a displacable supporting means in said cavity, said actuator protruding through said opposing grooves in said end walls and supporting a magnet at a first distal end;

a plate having at least one leg capable of depressing said actuator and attachable to said housing;

an optical sensor positioned so that a light beam is blocked by a second distal end of said actuator when a developing unit is mounted on said plate displacing said actuator towards said base and said first distal end supporting said magnet is rotated towards an electrical field generated by a plurality of charged toner.

2. The device of claim 1, further comprising said housing having a box-like shape.

3. The device of claim 1, further comprised of said cavity having an elongated shape.

4. The device of claim 1, further comprising:

said actuator having a shaft centrally attached to said actuator;

a bushing supporting said actuator and having a member attached to a bottom of said bushing perpendicular to the plane of said base; and a spring creating a separating force between said bushing and said housing, said spring attached at one distal end to said bushing, said spring attached at a second distal end to a bottom surface of said cavity.

5. The device of claim 1, further comprised of said side walls having a pair of opposing slots perpendicular to the plane of said base.

6. The device of claim 5, further comprising:

a cover having at least one aperture positioned over said bushing in said cavity; and said at least one leg insertable through said at least one aperture.

7. The device of claim 6, further comprising:

said cover having three apertures, two apertures positioned above said pair of opposing slots and one aperture positioned over said bushing; and said plate having three legs, two of said legs insertable through said apertures in said cover and insertably engagable with said pair of opposing slots, one of said legs insertable through a centrally positioned aperture and contactable with said bushing.

8. The device of claim 1, further comprised of said displacably supporting means being any one of either a spring centrally located in said cavity, a shock absorber centrally located in said cavity, a rod supported by a plurality of springs, a rod supported by a plurality of shock absorbers, and a hydraulic lift.

9. The device of claim 5, further comprising:

said pair of opposing slots both containing a supporting means, said supporting means attached at one distal end to said base and attached at a second distal end to an end of a rod parallel to said base; and said actuator pivotally mounted on said rod;

a cover having two apertures positioned over said pair of opposing slots; and said plate having two legs insertable through said apertures and contactable with said end of said rod.

10. The device of claim 9, further comprised of said supporting means being any one of either a spring centrally located in said cavity, a shock absorber centrally located in said cavity, a rod supported by a plurality of springs, a rod supported by a plurality of shock absorbers, and a hydraulic lift.

11. The device of claim 7, with said legs having a T cross-section causing said legs to be guided by said pair of opposing slots and said legs having a ridge preventing said legs from penetrating beyond a predetermined distance into said housing.

12. The device of claim 1, further comprised by sending a first constant voltage when either one of a toner exhaustion and a no developing unit condition exists, sending a second constant voltage when said developing unit is mounted on said plate and there is a sufficient amount of toner, and an intermediate signal of varying voltage when said toner is approaching an exhausted state.

13. A device for combination developing unit and toner level detecting, comprising:

a housing having a box-like shape, a base, and a cavity in a surface opposite said base, said cavity centrally located in said housing, said cavity forming two end walls and two side walls, said end walls having a pair of opposing grooves perpendicular to the plane of said base, said side walls having a pair of opposing slot s perpendicular to the plane of said base;

an actuator pivotally supported by a bushing in said cavity, said actuator protruding through said opposing grooves in said end walls and supporting a magnet at a first distal end;

a spring creating a separating force between said bushing and said housing, said spring attached at one distal end to said bushing, said spring attached at a second distal end to a bottom surface of said cavity a cover having three apertures, two of said apertures positioned over said pair of opposing slots and one of said apertures located over said bushing a plate having three legs, two of said legs insertable through said apertures and insertably engagable into said pair of opposing slots, one of said legs insertable through a centered aperture and contactable with said bushing;

an optical sensor positioned so that a light beam is blocked by a second distal end of said actuator when a developing unit is mounted on said plate compressing said spring and moving said actuator towards said base and said first distal end supporting said magnet is rotated towards an electrical field generated by a plurality of charged toner.

14. The device of claim 13, further comprised of said cavity having an elongated shape.

15. The device of claim 13, with said legs having a T cross-section causing said legs to be guided by said pair of opposing slots and said legs having a ridge preventing said legs from penetrating beyond a predetermined distance into said housing.

16. The device of claim 13, further comprised by sending a first constant voltage when either one of a toner exhaustion and a no developing unit condition exists, sending a second constant voltage when said developing unit is mounted on said plate and there is a sufficient amount of toner, and an intermediate signal of varying voltage when said toner is approaching an exhausted state.

17. The device of claim 13, with said spring being replaceable by a shock absorber.

18. A device for combination developing unit and toner level detecting, comprising:

a housing having a box-like shape, a base, and a cavity in a surface opposite said base, said cavity centrally located in said housing, said cavity forming two end walls and two side walls, said end walls having a pair of opposing grooves perpendicular to the plane of said base, said side walls having a pair of opposing slots perpendicular to the plane of said base;

an actuator pivotally supported by a rod in said cavity, said actuator protruding through said opposing grooves in said end walls and supporting a magnet at a first distal end;

said pair of opposing slots each containing a supporting means creating a separating force between said rod and said housing, said supporting means attached at one distal end to an end of said rod, said supporting means attached at a second distal end to a bottom surface of said cavity;

a cover having two apertures positioned over said pair of opposing slots;

a plate having two legs insertable through said apertures and insertably engagable into said pair of opposing slots;

an optical sensor positioned so that a light beam is blocked by a second distal end of said actuator when a developing unit is mounted on said plate compressing said supporting means and moving said actuator towards said base and said first distal end supporting said magnet is rotated towards an electrical field generated by a plurality of charged toner.

19. The device of claim 18, further comprised of said cavity having an elongated shape.

20. The device of claim 18, with said legs having a T cross-section causing said legs to be guided by said pair of opposing slots and said legs having a ridge preventing said legs from penetrating beyond a predetermined distance into said housing.

21. The device of claim 18, further comprised by sending a first constant voltage when either one of a toner exhaustion and a no developing unit condition exists, sending a second constant voltage when said developing unit is mounted on said plate and there is a sufficient amount of toner, and an intermediate signal of varying voltage when said toner is approaching an exhausted state.

22. The device of claim 18, further comprised of said supporting means being any one of either a plurality of springs, a plurality of shock absorbers, and plurality of hydraulic lifts.

23. A process of detecting both a developing unit and the toner level using a single detection device, comprising the steps of:

pivotally mounting an actuator in a cavity in a housing, said actuator protruding from two opposing sides of said housing and movable towards a base of said housing, said actuator having a magnet on a first distal end;

attaching said developing unit to a supporting plate capable of depressing said actuator;

positioning an optical sensor so that a second distal end of said actuator can interrupt a light beam sent by a light emitting device to a light receptor;

sending a first constant voltage signal when any one of either said developing unit is not mounted on said supporting plate and a toner exhaustion condition exists;

sending a second constant voltage when a developing unit is mounted on said plate and a sufficient amount of toner exists; and sending an intermediate and fluctuating voltage that has a frequency corresponding to how close said developing unit is to having its toner exhausted.

* * * * *